US005336115A

United States Patent [19]

Paulus

[11] Patent Number: 5,336,115

[45] Date of Patent: Aug. 9, 1994

[54] SURGE SUPPRESSION FILTER CONTACT CONNECTOR

[75] Inventor: Eric J. Paulus, Scottsdale, Ariz.

[73] Assignee: ITT Corporation, Secaucus, N.J.

[21] Appl. No.: 37,760

[22] Filed: Mar. 26, 1993

[51] Int. Cl.[5] ..... H01R 13/66

[52] U.S. Cl. ..... 439/620; 29/869

[58] Field of Search ..... 439/620, 608, 609, 796, 439/797; 29/869

[56] References Cited

U.S. PATENT DOCUMENTS

| | | | |
|---|---|---|---|
| 3,649,956 | 3/1972 | Vrobel | 339/103 B |
| 3,840,841 | 10/1974 | Clark | 339/147 P |
| 4,484,159 | 11/1984 | Whitley | 333/182 |
| 4,494,092 | 1/1985 | Griffin | 333/182 |
| 4,600,262 | 7/1986 | Nieman et al. | 339/147 |
| 4,746,310 | 5/1988 | Morse et al. | 439/620 |
| 4,768,977 | 9/1988 | Gliha, Jr. et al. | 439/620 |
| 4,789,360 | 12/1988 | Paul et al. | 439/620 |
| 4,846,732 | 7/1989 | Meelhuysen | 439/620 |
| 4,954,794 | 9/1990 | Nieman et al. | 333/182 |
| 5,188,543 | 2/1993 | Swift | 439/620 |

*Primary Examiner*—Eugene F. Desmond
*Attorney, Agent, or Firm*—Thomas L. Peterson

[57] ABSTRACT

A connector with filter contacts enables removal of an individual surge suppression contact from the mating front end of the connector. The connector includes inserts (30–36, FIG. 1) forming contact-receiving passages (60), with the inserts inserted through the rear of a shell (14) until a frontmost insert (30) abuts a flange (40) at the front of the shell. The frontmost insert has a cavity (50) that holds a contact-retention clip (100), with the clip oriented so its band (102) is frontmost and its tines (104) extend rearwardly therefrom. A suppression contact (62) in each passage has a front end (64) projecting forward of the frontmost insert and has a forwardly-facing shoulder (110) lying substantially against the rear ends of the retention clip tines. The rear end (66) of each contact engages a wiring terminal (132) in a pin-and-socket connection. A suppression contact is removed by inserting a tool into the front end of the passage or cavity to expand the tines of the retention clip, and pulling out the contact through the front end of the connector.

5 Claims, 3 Drawing Sheets

CIR.
26
24
134
150
22
152
132
144
10
140
148
146
142
14
12
130
36
131
66
133
56
114
112
94
16
34
54
32
52
50
30
38
40
20
88
90
60
62
110
106
104
102
100
122
64
70
42
R
F

SURGE SUPPRESSION FILTER CONTACT CONNECTOR

BACKGROUND OF THE INVENTION

In many applications, connectors include signal surge suppression contacts with diodes that act like a shunt to dissipate high voltage pulses to ground, to protect circuitry. If a suppression contact is damaged, it can be removed and replaced. U.S. Pat. No. 4,954,794 by Nieman et al describes a connector of this type. In prior connectors of this type, each suppression contact commonly had its rear end attached to a wire as by crimping and soldering. The replacement of a damaged suppression contact required opening up the rearward end of the contact to expose the "rats nest" of wires extending therefrom, and inserting a release tool forwardly into a passageway holding the contact to be replaced, so the contact could be pulled rearwardly out of the rest of the connector. This was followed by detaching the rear of the contact from a corresponding wire, attaching the replacement contact to the wire, and inserting the new contact forwardly into the rear of the connector. The need to open up the rear of the connector and remove a contact through the "rat's nest" of wires, made it difficult to replace a damaged suppression contact. A connector which facilitated replacement of damaged suppression contacts, would be of considerable value.

SUMMARY OF THE INVENTION

In accordance with one embodiment of the present invention, a connector is provided of the type that includes removable surge suppression contacts, which facilitates removal of a defective suppression contact. The connector includes inserts that can be installed through the rear of a shell until a frontmost insert abuts a flange on the shell. The inserts have aligned holes forming contact-receiving passages, and a suppression contact lies in each of at least some of the passages. One of the inserts such as the frontmost one, has a cavity that holds a retention clip. Each suppression contact has a forwardly-facing shoulder at its forward portion, and a clip lying in a cavity has tines with rear ends that engage the suppression shoulder. When a release tool is inserted through the front mating end of the connector into a passage, it expands the clip tines so the suppression contact can be pulled out through the front end of the connector.

The connector includes a plurality of terminals lying behind the suppression contacts, with each terminal connected to a wire that leads to circuitry which the connector is coupled to. Each terminal has a front end that mates with the rear end of a suppression contact in a pin-and-socket joint. Thus, when a suppression contact is pulled forwardly out of the connector, its rear end unmates from a corresponding wired terminal while the terminal remains connected to the circuitry.

The novel features of the invention are set forth with particularity in the appended claims. The invention will be best understood from the following description when read in conjunction with the accompanying drawings.

DESCRIPTION OF THE PREFERRED EMBODIMENT

Figure 1:
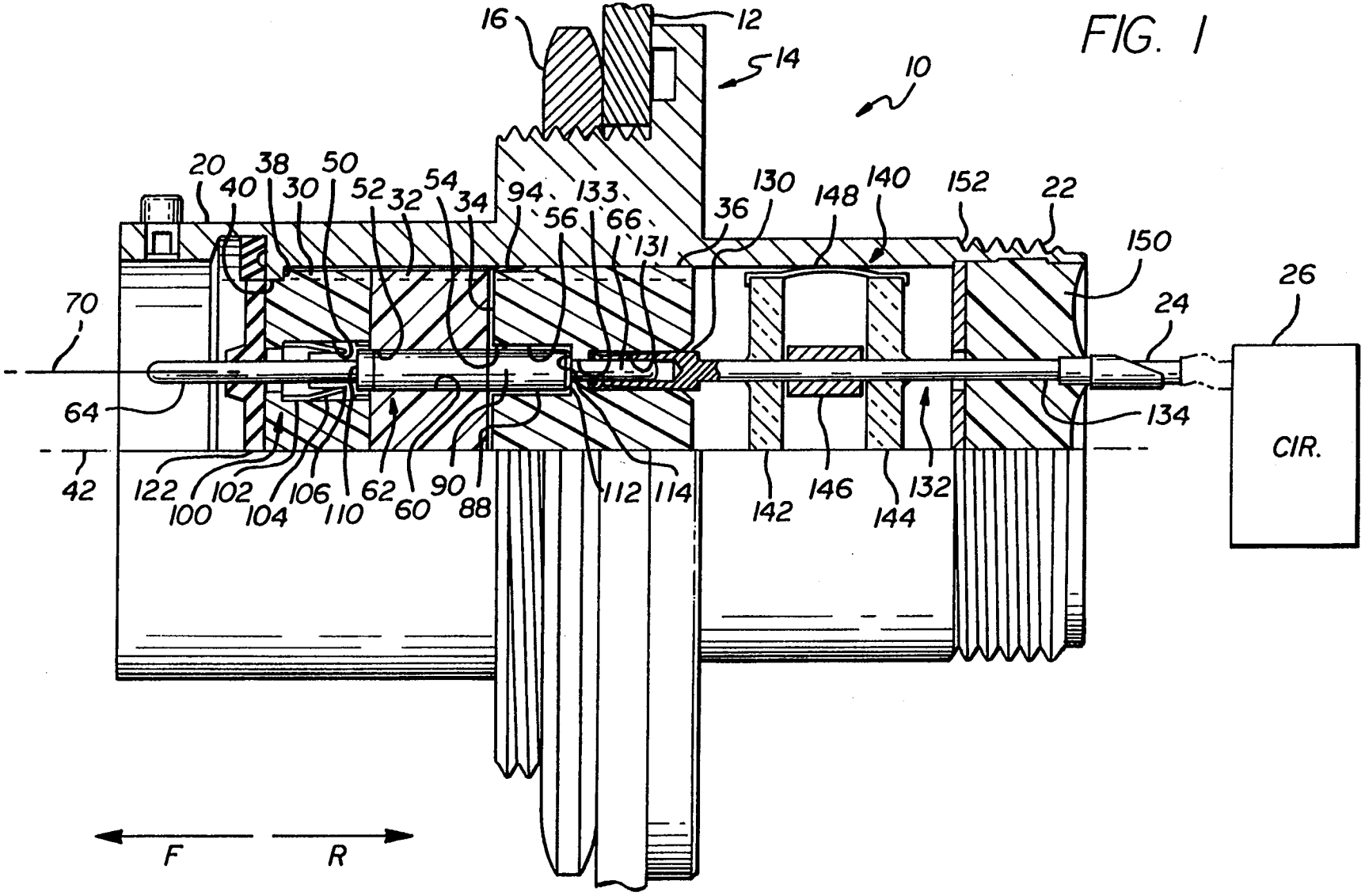
FIG. 1 is a side view of a connector constructed in accordance with the present invention, with the upper half showing the connector in cross section and the lower half showing the connector in elevation.
Figure 2:
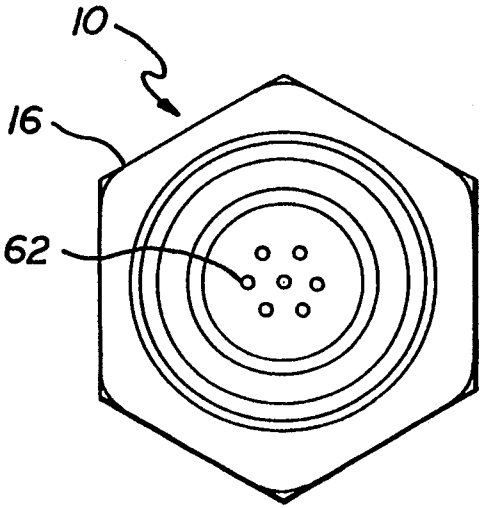
FIG. 2 is a front elevation view of the connector of FIG. 1.

FIG. 1 illustrates a connector 10 showing it mounted on an electrically grounded mounting plate 12. The connector includes a metal shell 14 held to the mounting plate 12 by a jam nut 16. The shell, which is preferably in one piece but which can have two or more parts, has a forward mating end 20 that mates with another connector and a rearward end 22 that may be connected to wires 24 extending to circuitry 26 to which the connector is substantially permanently connected.

A plurality of inserts 30–36 lie within the shell, one behind the other. A first or frontmost insert 30 abuts an internal shoulder 38 formed on a shell flange 40 that extends radially inwardly towards the axis 42 of the shell. The inserts 30–36 can be installed in a forward direction F through the rearward end 22 of the shell until stopped by the flange 40 from moving forwardly out of the shell. All of the inserts, except for insert 34, are of dielectric material, with grounding conductor insert 34 being electrically conductive.

Each of the inserts has a plurality of holes 50–56, with the holes being aligned to form a plurality of contact-receiving passages 60, only one of them being shown in FIG. 1. A suppression contact 62 lies in each of the plurality of passages 60. Each suppression contact has a forward contact mating portion 64 that projects forwardly from the inserts, and has an opposite rear end 66, the opposite ends being spaced along a contact axis 70. The suppression contact is used to carry signals, and may be referred to as a signal contact.

Figure 3:
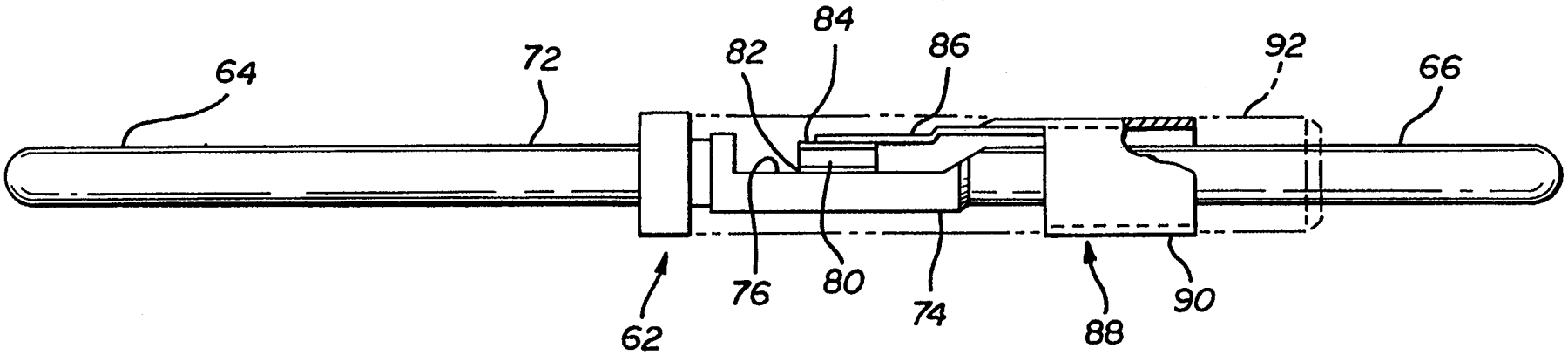
FIG. 3 is a side elevation view of a surge suppression contact of the connector of FIG. 1.
Figure 4:
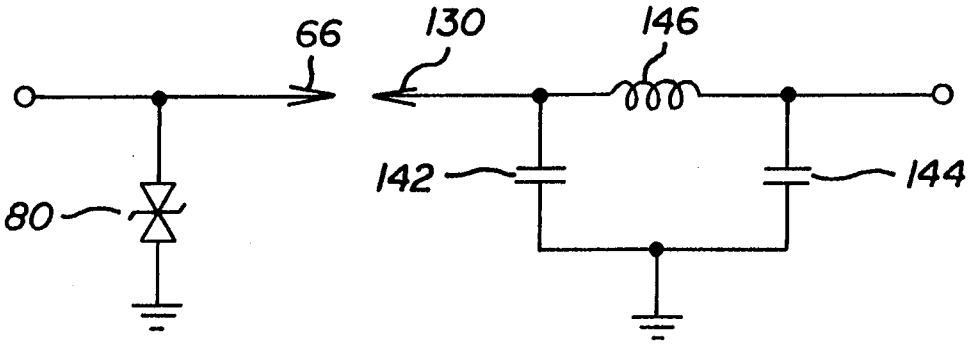
FIG. 4 is a schematic diaphragm of the circuitry of the suppression contact and filter array of the connector of FIG. 1.

As shown in FIG. 3, the suppression contact 62 includes a conductive body 72 forming the forward and rearward ends 64, 66 of the contact, and forming a middle portion 74 with a notch forming a platform 76. A surge suppressing electronic component 80, which is usually a diode, is mounted on the platform. The diode acts like a shunt to dissipate high voltage pulses, but can be damaged when suppressing such a pulse. The diode has one terminal 82 attached to the platform and another terminal 84 attached to an extension 86 of a grounding contact device 88. The grounding contact device 88 has a ring shaped end 90. A cylindrical body 92 of an insulative encapsulate such as epoxy surrounds most the middle portion of the contact, except that the cylindrical end 90 of the grounding contact 88 is left exposed.

When the suppression contact is installed in the connector as shown in FIG. 1, the cylindrical end 90 of the grounding contact device 88 engages the grounding device insert 34. The grounding device insert 34 can be formed from a sheet of metal, with fingers at each hole 54 that engage the cylindrical end 90 of the contact ground, and having outer grounding fingers 94 which engage an inner surface of the metal shell 14.

In accordance with the present invention, the suppression contact 62 is retained in the connector in a manner that enables removal of the suppression contact from the mating front end 20 of the connector shell. The suppression contact 62 is normally prevented from moving in a forward direction F out of the connector by a contact retention device as in the form of a retention clip 100. The clip lies in a hole or cavity 50 of the first insert 30. The clip can be of the type that includes an interrupted band 102 and a plurality of tines 104 that extend in a rearward direction R from the band, the tines having rearward ends 106. The suppression contact is formed with a largely forwardly-facing contact shoulder 110 that substantially abuts the rear ends 106 of the retention clip tines. Until the tines are spread apart by a release tool, the tines prevent the contact from moving in a forward direction out of the connector.

Figure 5:
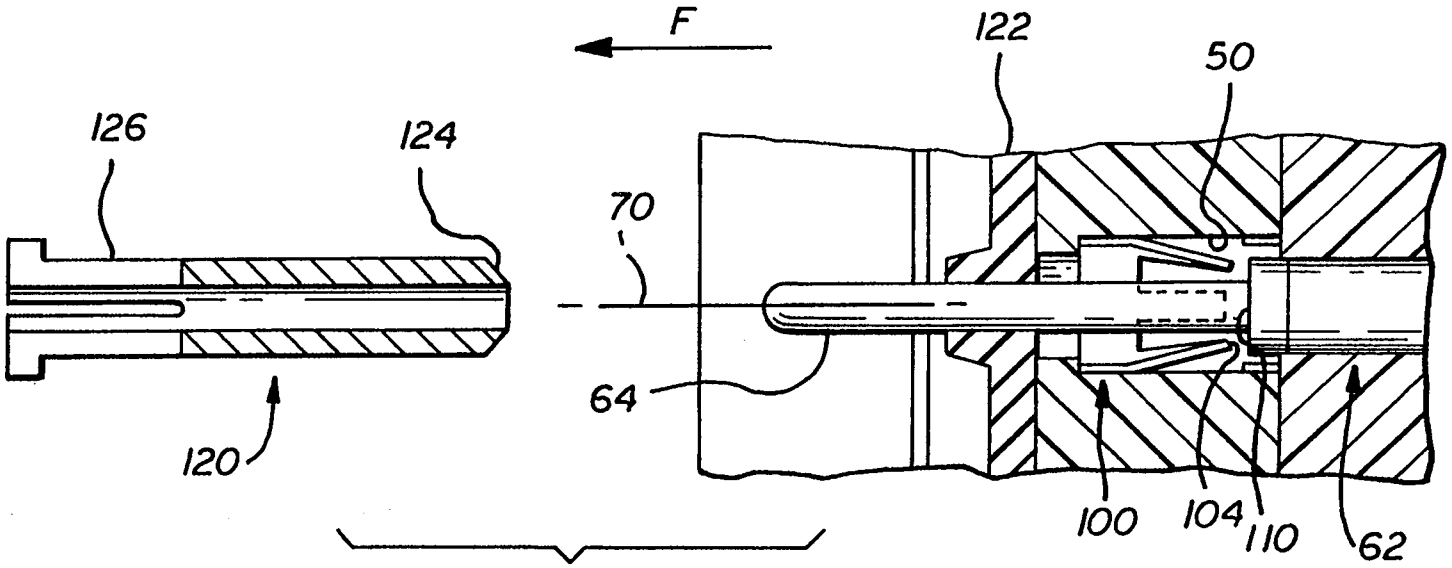
FIG. 5 is a partial sectional side view showing the manner in which a release tool is used to remove a suppression contact from the connector of FIG. 1.

FIG. 5 shows the manner in which the suppression contact can be removed from the front end of the connector. A release tool 120 is inserted around the pin-shaped contact forward portion 64 and displaces a soft rubber front seal 122 until the release tool 120 enters the cavity 50 in which the retention clip 100 lies. In some cases, the seal 122 first must be removed. The release tool is inserted until its front end 124 substantially abuts the contact shoulder 110, at which time the release tool will have deflected the clip tines so they are out of line with the contact shoulder 110. With the release tool 120 fully inserted, it and the contact can be pulled in a forward direction F out of the connector. Such pulling can be accomplished in a number of ways, as by using a clamp to compress a forward end portion 126 of the release tool to grasp the contact front portion 64 and by pulling out the clamp (which may be a pliers, etc.).

Referring again to FIG. 1, it can be seen that the rear end 66 of the contact is in the form of a pin that is mated to a socket 130 of a rear wiring terminal 132. The socket 130 lies closely within a rear portion 131 of the insert hole 56, while the pin 66 lies closely with a more forward hold portion 133. The rear terminal 132 has a rear end 134 that is engaged with one of the wires 24, as by crimping a ferrule lying on the wire, to the rear end 134 of the terminal and/or soldering them together. When the suppression contact 64 is pulled in a forward direction F out of the connector, it disconnects from the terminal 132 in the usual manner of separation of a pin contact from a socket contact. The holding force between the pin and socket 66, 130 is moderate, and does not significantly resist pullout of the suppression contact 62. It may be noted that a pin and socket contact can have two identical leaves that wipe across each other.

Applicant prefers to connect a pi filter array 140 to the rear terminal 132 to additionally filter EMI (Electromagnetic Interference) that may be induced in the surge suppression contact. Such a pi filter array is known, and can include a pair of ceramic capacitors 142, 144 and a ferrite bead 146 connected as shown, with each capacitor connected to the rear terminal and connected to the shell through a grounding spring 148. However, whether or not the filter array is used, the rear terminal 132 remains in place in the connector when the suppression contact 62 is pulled forwardly out from the connector. Due to the fact that the filter array in the terminal 132 must seldom, if ever, be replaced, applicant prefers to permanently seal the rear of the connector by a potting material 150 which surrounds the rear end of the terminal, with the front end of the mass of potting material abutting an insulating plate 152.

In prior art removable suppression contacts, the suppression contacts were removed from the rear of the connector. If the connector has many contacts, the rear of the connector is a "rats nest" of wires. When the rear of the connector is disconnected from the circuitry and a suppression contact is replaced from the rear, there is a possibility of damage to other wires. For a rear removable suppression contact, the release tool had to have a wide slit in one side so as to fit over a wire, which could make it difficult to turn the tool to insert it and hamper spreading apart of the tines of the retention clip. Applicant can use such a prior art tool, but also can use a release tool, shown in FIG. 5, which does not have a such wide slot to receive a wire. The ability to remove a suppression contact from the front end of the connector, greatly simplifies replacement. After a suppression contact is removed, a replacement suppression contact is installed by merely pressing the replacement suppression contact in a rearward direction R into a passage, until the rear pin end 66 of the replacement suppression contact mates with the socket 130 at the front of the rear terminal 132, and the rear ends 106 of the clip tines snap in front of the contact shoulder 110. A rearwardly-facing shoulder 112 on the filter contact abuts an abutment 114 on the rear insert 36, to limit rearward movement of the suppression contact.

Thus, the invention provides a connector of the type that includes suppression contacts, such as a contact with a diode mounted thereon (and possibly more than one circuit component thereon), which facilitates replacement of a damaged suppression contact. The suppression contact has a largely forwardly-facing shoulder at its forward portion. The suppression contact is captured in a passageway formed by a group of inserts, by a clip whose tines extend largely rearwardly so their rearward ends can abut the contact shoulder. This enables removal of the suppression contact by installing a release tool through the front of the connector, that spreads apart the clip tines to enable the suppression contact to be pulled in a forward direction out of the front mating end of the connector. The connector includes a plurality of rear terminals that are each connected to a wire leading to electrical circuitry. The front end of each terminal mates to the rear end of a suppression contact in a pin-and-socket joint, for simple decoupling of the suppression contact when removed and simple coupling of the replacement suppression contact with the rear terminal.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector which includes a shell having a forward mating end for mating with another connector device and having a rearward end, wherein said shell forward end forms a rearwardly-facing internal shoulder, and which includes a plurality of inserts that lie one behind the other in said shell, with one of said inserts abutting said shoulder to prevent said inserts from moving forwardly out of said shell and with each of said inserts having a plurality of holes aligned with those of the other of said inserts to form a plurality of contact-holding passages that each has an axis, and which also includes a plurality of suppression contacts each lying in a different one of said passages wherein each suppression contact forms a forward contact mating portion and a rear contact mating portion, and which also includes a plurality of retainer parts which each lies in one of said passages and retains a corresponding contact to prevent its forward movement out of said passage but which can be operated to release the contact to move forwardly out of the passage, and which also includes a plurality of rear terminals with each rear terminal having a rear end and having a front end which detachably mates to a suppression contact rearwardly-extending pin characterized by:

each of said front contact mating portions is in the form of a pin lying on said axis and each of said terminal front ends is in the form of a socket that has a plurality of leaves lying on different sides of said axes and which mates with said pin in a pin-and-socket connection;

a first rearmost insert has a rear hole portion that closely surrounds a corresponding one of said sockets to keep it aligned with a corresponding passage axis, with each hole in said rearmost inset forming a narrower front hole portion that can guide a corresponding rearwardly-extending pin as it moves rearwardly to mate with a socket.

2. The connector described in claim 1 wherein:

said rearmost insert forms an abutment within each of said holes therein;

each of said suppression contacts has an enlargement forward of said pin and forming a rearwardly-facing shoulder that directly abuts a corresponding one of said abutments.

3. A connector which includes a shell having a forward mating end for mating with another connector device and having a rearward end, wherein said shell forward end forms a rearwardly-facing internal shoulder, and which includes a plurality of inserts that lie one behind the other in said shell, with one of said inserts abutting said shoulder to prevent said insets from moving forwardly out of said shell and with each of said inserts having a plurality of holes aligned with those of the other of said inserts to form a plurality of contact-holding passages that each has an axis, and which also includes a plurality of suppression contacts each lying in a different one of said passages wherein each suppression contact has a body with a front end and a pin-shaped rear end and a middle and each contact has a diode mounted on said middle and has a grounding contact device connected to sad diode and having an exposed ring-shaped part lying around but out of engagement with said body, and said connector also includes a plurality of retainers which each lies in one of said passages and retains a corresponding contact to prevent its forward movement out of said passage but which can be operated to release the contact to move forwardly out of the passage, and which also includes a plurality of rear terminals with each rear terminal having a rear end having a front end socket which mates to a suppression contact rearwardly-extending pin, characterized by:

a first of said inserts is of dielectric material and has a hole, and a second of said inserts is a grounding inset that is formed of metal and that lies against the front of said first insert, with grounding insert having a projection lying in said first insert hole;

said ring-shaped part of said first contact lies in said first inset hole and against said grounding insert projection, and said first insert has a narrow hole part the closely surrounds said contact pin to guide it into said socket.

4. A method for replacing a first of a plurality of surge suppressing signal contact of a connector, where each of said contact lies in a passage that has an axis and that is formed in an a insert assembly that lies within a metal shell, where the insert assembly comprises a plurality of inserts having aligned holes forming a plurality of passages including said first passage, where most of the axial length of the insert assembly is of dielectric material but a first grounded insert is metal and is connected to said shell and has a grounding projection lying in it hole, where said first contact has a front and a pin-shaped rear end and a middle and includes a diode mounted on said middle and a grounding contact device connected to said diode and having an exposed ring-shaped part lying around, but out of engagement with said middle, and the connector includes a plurality of terminals each fixed within said shell and generally lying behind said contact rear end with said terminals each having a socket forward end slidably mated with a corresponding contact pin-shaped rear end, which includes releasing said first contact from said insert and pulling it forwardly out of said connector, characterized by:

sliding a new surge suppressing first contact, that is substantially identical with said first contact rearwardly into said first passage, including moving said exposed ring-shaped part against said grounding projection and substantially inserting said pin-shaped rear end into said socket including spreading apart socket leaves, while keeping said socket aligned with said axis by walls of the hole portion in a rearmost of said inserts.

5. The method described in claim 4 including:

closely positioning said socket within a rearward part of a hole in one of said inserts, and guiding said pin through a narrower forward part of said hole that lies in said one of said inserts.

* * * * *